United States Patent [19]

Carlson

[11] 4,367,452

[45] Jan. 4, 1983

[54] THERMOSTATIC SWITCH CONSTRUCTION

[75] Inventor: Richard H. Carlson, Cumberland, R.I.

[73] Assignee: Elmwood Sensors, Inc., Cranston, R.I.

[21] Appl. No.: 347,842

[22] Filed: Feb. 11, 1982

[51] Int. Cl.[3] ..... H01H 37/52

[52] U.S. Cl. ..... 337/362; 337/365

[58] Field of Search ..... 337/342, 343, 362, 365, 337/372

[56] References Cited

U.S. PATENT DOCUMENTS 3,577,111 5/1971 Nardulli ..... 337/365

4,317,097 2/1982 Hofsass ..... 337/343

*Primary Examiner*—George Harris

*Attorney, Agent, or Firm*—Salter & Michaelson

[57] ABSTRACT

A bimetallic, disc-actuated, thermostatic switch comprising a resiliently deformable actuator disc having an integrally struck actuator arm which extends radially inwardly to a point adjacent to a fixed contact. When the bimetallic disc is flexed in response to a predetermined temperature change, it applies pressure to the edge of the actuator disc proximal to the stem of the actuator arm causing the actuator disc to be resiliently deformed and causing the arm to be pivoted on a fulcrum in the switch, thereby causing the terminal end of the arm to move relative to the fixed contact to either open or close the switch. Since the arrangement is such that the edge of the bimetallic disc exerts pressure on the actuator disc, maximum deformation is imparted to the actuator disc thereby achieving maximum movement of the actuator arm for a given size bimetallic disc, thus permitting relatively small discs to be successfully utilized.

21 Claims, 13 Drawing Figures

FIG. 7
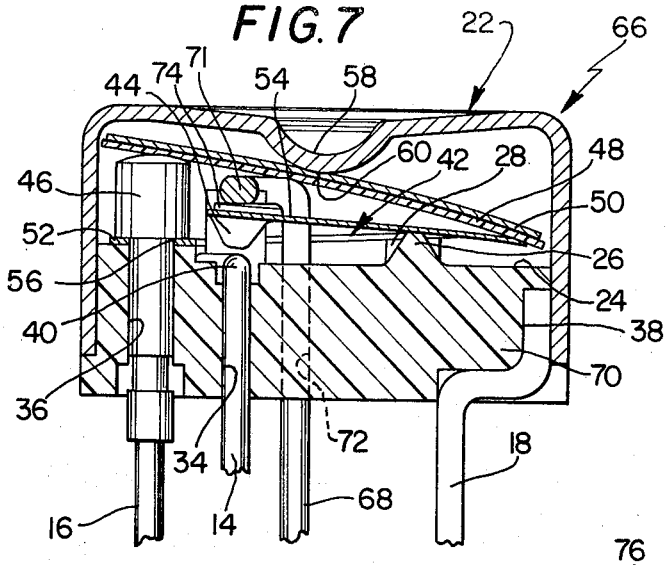
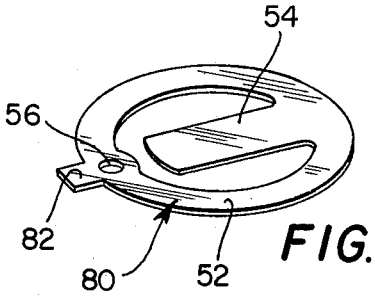
FIG. 8
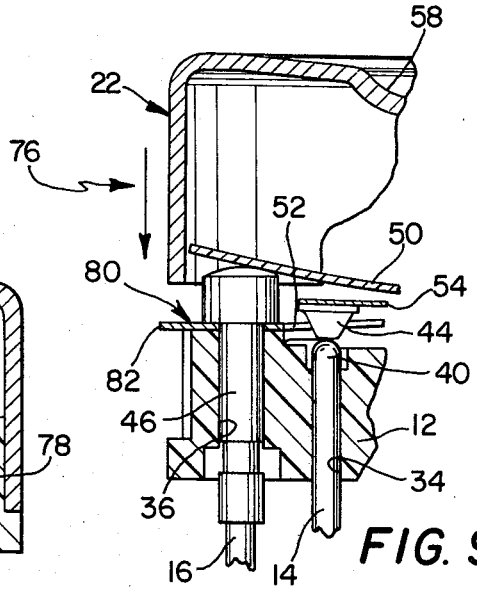
FIG. 9
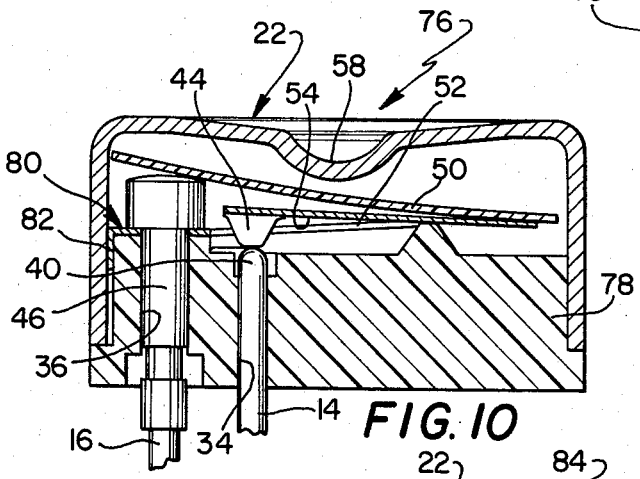
FIG. 10
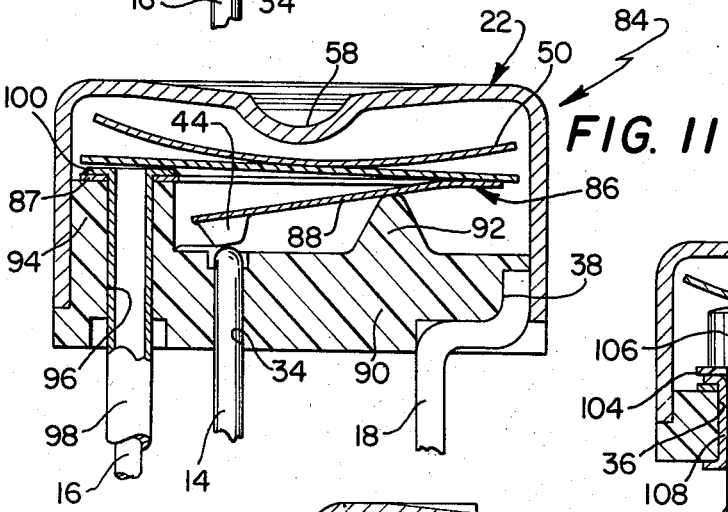
FIG. 11
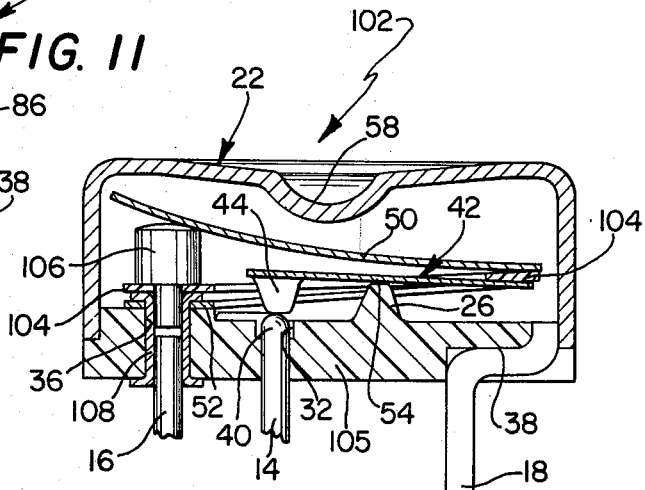
FIG. 12
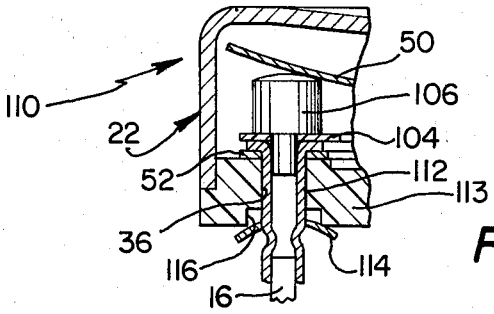
FIG. 13

THERMOSTATIC SWITCH CONSTRUCTION

BACKGROUND & SUMMARY OF THE INVENTION

The instant invention relates to bimetallic, disc-actuated, thermostatic switches and the like, and more particularly to a novel construction for such switches particularly suited for miniaturization.

As a result of the growing trend toward the miniaturization and weight reduction of electrical components in today's industry, a substantial need has developed for a reliable bimetallic, disc-actuated, thermostatic switch construction which is readily adaptable to miniaturization. In this connection, while the heretofore known bimetallic, disc-actuated, thermostatic switches have proven to be effective and accurate in most applications, they have not been readily adaptable to miniaturization. This is a result of the fact that substantially all of the bimetallic, disc-actuated, thermostatic switches heretofore known have relied solely on direct unamplified disc flexing movement to move contacts in order to effect switching. While this type of switch construction is effective in applications where switch size is not critical, it is not readily adaptable to miniaturization. Unfortunately, as the size of a bimetallic disc is reduced, the amount of flexing movement or snap travel which is capable of being exerted on a movable contact is correspondingly reduced. Since a certain minimum amount of contact travel is essential to effect accurate switching, the size of the bimetallic disc cannot normally be reduced beyond certain minimum limits. The only exception to this has been where switch components have been produced in accordance with critical tolerancing, which has greatly increased their cost.

The instant invention provides an effective bimetallic, disc-actuated, switch construction wherein the movement of a bimetallic disc is amplified so that adequate contact movement can be achieved even when the bimetallic disc is of relatively small size. In particular, the switch construction of the instant invention includes a base having a fixed contact thereon, a fulcrum which extends upwardly from the base and is spaced from the fixed contact, and a support post which extends upwardly from the base spaced on the opposite side of the fixed contact from the fulcrum. A resiliently deformable actuator disc having a peripheral ring which defines an interior open area, and having an integrally struck actuator arm which extends radially inwardly from the ring into the open area, is secured to the base by the support post with the arm of the disc overlying the fulcrum and extending to a point adjacent the fixed contact. A bimetallic disc is positioned adjacent the actuator disc in the switch and is retained in general alignment. therewith by a housing which also encompasses and protects the components of the switch. When the bimetallic disc flexes in response to a predetermined temperature change, the central portion thereof engages an abutment on the housing so that opposed edge portions of the bimetallic disc are simultaneously pressed against both the support post and the ring of the actuator disc adjacent to the actuator arm. Since the support post is rigid, this causes the actuator disc to be resiliently deformed whereby the actuator arm pivots on the fulcrum to move the terminal portion of the arm either away from or into engagement with the fixed contact. Since the actuator arm has the effect of amplifying the movement of the bimetallic disc as the former pivots on the fulcrum, this permits electrical continuity between a movable contact carried on the actuator arm and the fixed contact to be accurately gauged for opening or closing, even when the bimetallic disc is of miniature size. Movement of the arm is further maximized due to the fact that pressure on the actuator disc is exerted by an edge of the bimetallic disc, where the snap travel of the latter is the greatest. When temperature conditions permit the disc to relax and return to its normal position, pressure on the actuator disc is relieved and the actuator arm resiliently and automatically returns to its original position. The novel concept of amplifying the flexing movement of a bimetallic disc through a lever arm in this manner permits the miniaturization of bimetallic, disc-actuated, thermostatic switches without substantial reductions in the accuracy or effectiveness thereof.

Thermostatic switch constructions representing the closest prior art to the instant invention of which the applicant is aware are illustrated in the U.S. patents to MALONE, No. 2,632,824; MALONE, No. 2,823,283; EPSTEIN, No. 2,864,918; STAHL, No. 3,170,998; MORO, No. 3,329,788; NARDULLI, No. 3,577,111; TAYLOR. No. 4,152,998 and TAYLOR, No. 4,160,226. A number of the above patents illustrate thermostatic switch constructions wherein a radially extending arm is blanked from a bimetallic disc so that when the disc is stressed, the arm will swing upwardly or downwardly to open or close the switch. Examples of switches of this type are disclosed in the patents to TAYLOR and EPSTEIN. The MORO patent teaches a thermostatic switch construction wherein a bimetallic disc imparts movement to a radial arm in a separate circular member to open or close the switch. However, the radial arm does not cooperate with the bimetallic disc in the manner taught by the instant invention. Nor do any of the other patents, including TAYLOR or EPSTEIN, illustrate or teach the combination that characterizes this invention.

For all of the above reasons, it is the primary object of the instant invention to provide a reliable and accurate bimetallic, disc-actuated, thermostatic switch construction which is suitable for miniaturization.

Another object of the instant invention is to provide a means of amplifying the snap travel of a bimetallic disc in a thermostatic switch.

Other objects, features and advantages of the invention shall become apparent as the description thereof proceeds when considered in connection with the accompanying illustrative drawings.

DESCRIPTION OF THE DRAWINGS

In the drawings, which illustrate the best mode presently contemplated for carrying out the present invention:

FIG. 7 is a side sectional view of an alternate embodiment of the switch of the instant invention;

FIG. 8 is a perspective view of another alternate embodiment of the actuator disc;

FIG. 9 is a fragmentary side sectional view illustrating the assembly of the housing on a switch which includes the actuator disc of FIG. 8.

FIG. 10 is a view of the switch illustrated in FIG. 9 subsequent to the assembly of the housing thereon;

FIG. 11 is a side sectional view of another alternate embodiment of the switch;

FIG. 12 is a side sectional view of a still further embodiment of the switch; and FIG. 13 is a fragmentary side sectional view of a still further embodiment of the switch.

DESCRIPTION OF THE INVENTION

Figure 1:
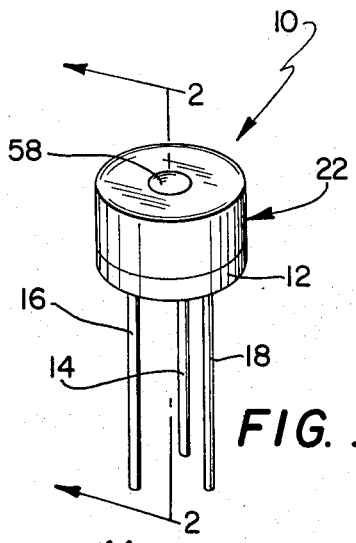
FIG. 1 is a perspective view of one embodiment of the thermostatic switch construction of the instant invention.

Referring now to the drawings, particularly FIGS. 1 through 5, a first embodiment of the thermostatic switch construction of the instant invention is generally indicated at 10. The switch 10 is a single pole, single throw type switch and generally comprises a base 12 made of an electrical insulating material, first, second and third external electrical terminals 14, 16 and 18, respectively, a bimetallic disc switching assembly generally indicated at 20, and a housing or enclosure generally indicated at 22 which houses the assembly 20. The switch 10 operates to alternatively effect or interrupt electrical continuity between the first and second terminals 14 and 16 by means of the switching assembly 20 in response to a predetermined temperature change.

Figure 2:
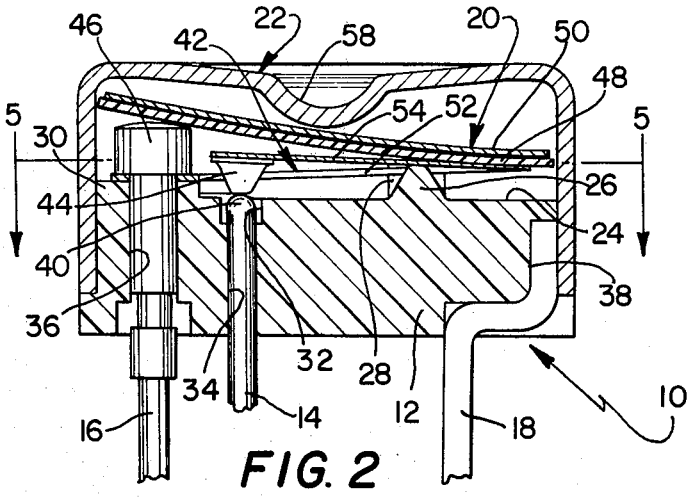
FIG. 2 is an enlarged sectional view taken along line 2—2 in FIG. 1 with the bimetallic disc thereof in its normal or unstressed position.
Figure 3:
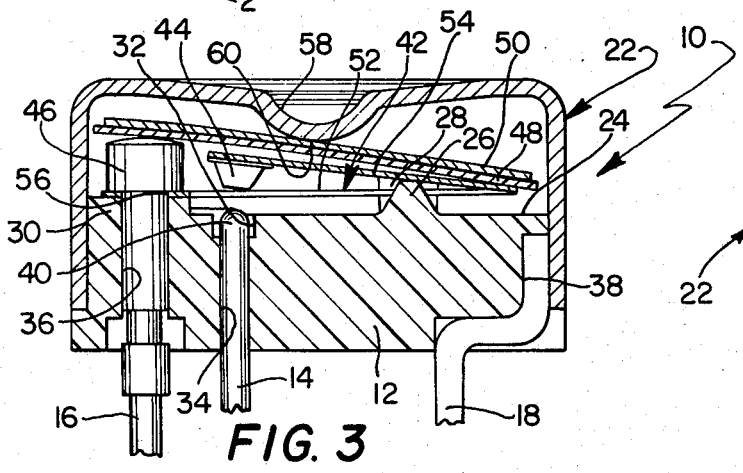
FIG. 3 is a similar view with the bimetallic disc thereof in its stressed or flexed position.
Figure 4:
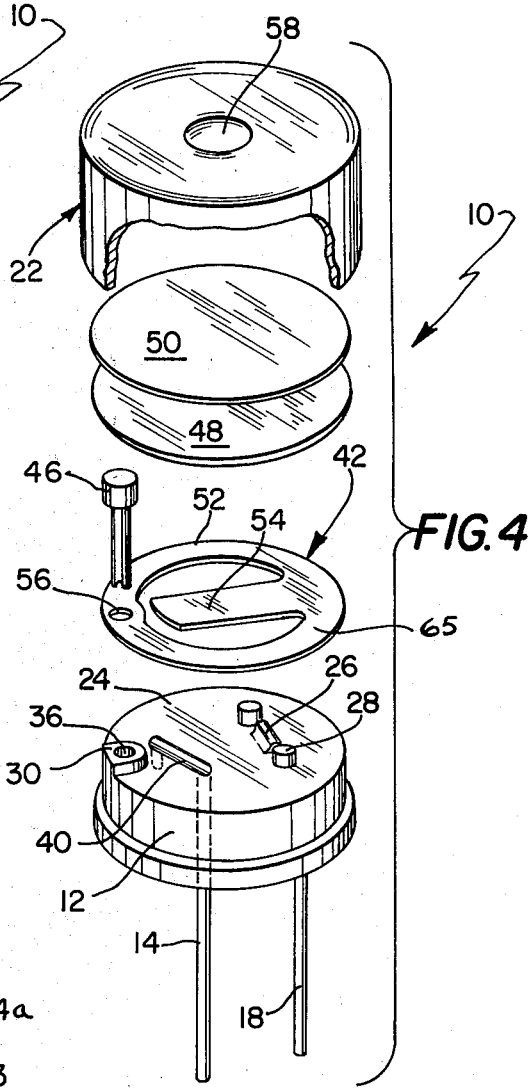
FIG. 4 is an exploded perspective view of the switch.
Figure 5:
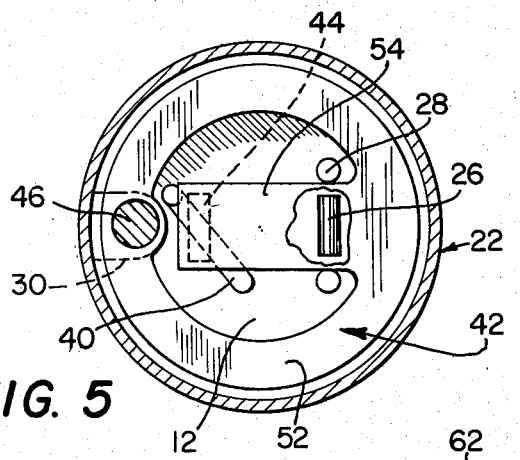
FIG. 5 is a sectional view taken along line 5—5 in FIG. 2.

The base 12, which is preferably formed of an electrical insulating material such as a phenolic, is most clearly illustrated in FIGS. 2, 3 and 4. As will be seen, the base 12 is preferably molded in a generally circular configuration, and has a substantially flat upper surface 24. Integrally molded with the base 12 and upstanding from the surface 24 are a fulcrum bar 26, positioning bosses 28 which are disposed proximal to the opposite extremities of the bar 26, and a support post boss 30 which is spaced from the fulcrum bar 26. A recessed slot 32 is provided on the upper surface 24 between the boss 30 and the fulcrum 26, and a bore 34 extends downwardly through the base 12 from the slot 32. A bore 36 extends downwardly through the boss 30 and the base 12, and an L-shaped slot 38 in communication with the outer surface of base 12 extends downwardly from a point below surface 24 and then inwardly.

The switching assembly 20 comprises a first fixed contact 40, an actuator disc generally indicated at 42, a movable contact 44, an electrically conductive support post 46, an insulator disc 48 and a bimetallic disc 50. The switching assembly 20 is operable to move the movable contact 44 into and out of engagement with fixed contact 40 to correspondingly effect or interrupt electric continuity between the first and second external terminals 14 and 16, respectively.

The actuator disc 42 comprises a resiliently deformable disc which is preferably made of a resilient sheet metal, such as berylium copper, and is defined by a peripheral ring 52 and an integral actuator arm 54 which extends radially inwardly from the ring 52 into the open interior area thereby defined. An opening 56 is provided in the ring 52 distal from the stem of the arm 54 for securing the disc 42 to the base 12 by means of the post 46. When the actuator disc 42 is secured in this manner, the ring 52 is spaced slightly upwardly from the surface 24 as a result of the boss 30, and when the disc 42 is in a relaxed or unstressed position, as illustrated in FIG. 2, the movable contact 44 is in engagement with the fixed contact 40, with the arm 54 partially stressed and slightly displaced from a planar relation with the ring 52. The disc 42 is resiliently deformable to a stressed position, as illustrated in FIG. 3, wherein the arm 54 is elevated further above the plane of the ring 52 as will be hereinafter more fully set forth.

The housing or enclosure 22 comprises a metallic housing of generally circular configuration which is received on the base 12 and secured thereto by conventional means whereby the housing 22 and the base 12 cooperate to define an interior chamber for the switching assembly 20. As herein embodied, the housing 22 includes a central downwardly extending dimple or abutment 58 which cooperates with the discs 48 and 50 and the post 46 to effect switching in the switch 10 as will be hereinafter more fully brought out.

The assembled configuration of the switch 10 is sectionally illustrated in FIGS. 2 and 3. As will be seen, the first and third terminals 14 and 18, respectively, are received in the bore 34 and the slot 38, respectively. The post 46 is received in the opening 36 and the second terminal 16 is secured to the post 46. The fixed contact 40 preferably is an integral extension of the first terminal 14 and is retained in the slot 32 on the upper surface 24. The actuator disc 42 is secured to the base 12 by means of the post 46, it being noted that the latter extends through the opening 56. The actuator disc 42 is retained in generally aligned relation above the surface 24 by the bosses 28 which position the arm 54 over the fulcrum 26. The fulcrum 26 engages the arm 54 at a point adjacent its fixed end and the arm 54 extends therefrom generally above the fixed contact 40. The movable contact 44 is mounted on the underside of the terminal end of arm 54 so that the movable and fixed contacts 44 and 40 are in engagement when the disc 42 is in its unstressed or undeformed position illustrated in FIG. 2. In this connection, it is understood that references to the unstressed or undeformed position of the disc 42 are intended to be relative for purposes of comparison with the stressed or deformed position thereof which will hereinafter be described. Accordingly, it is understood, as previously suggested, that the arm 54 may be slightly resiliently bent or stressed upwardly as illustrated in FIG. 2 to provide pressurized engagement of the contacts 40 and 44 when the disc 42 is in its "unstressed" position. The insulator disc 48 and the bimetallic disc are disposed generally above the actuator disc 42 and retained in general alignment therewith by the housing 22. Since the housing 22 is of metallic construction and engages the third terminal 18, it functions as a grounding shield for the switch assembly 20 when the terminal 18 is appropriately grounded in a manner well known in the art.

As will be seen from FIG. 2, when the disc 50 is in its unstressed or downwardly flexed position, it rests on top of insulator disc 48 which in turn rests on post 46 and the ring 52 proximal to the stem of the arm 54. When the disc 50 is in this position, it is slightly spaced from the dimple 58 so that no significant pressure is applied to the ring 52. However, when the disc 50 is exposed to a predetermined temperature change so that it stresses and flexes upwardly to the position illustrated in FIG. 3, the interior portion of the disc 50 engages the dimple 58 as at 60 causing the perimetric portions of the disc 50 to be urged downwardly against the post 46 and the ring 52. Since both the post 46 and the dimple 58 are stationary and immovable, the disc 50 pivots on the dimple 58 causing the disc 42 to be resiliently deformed, i.e., the portion of the ring 52 which is proximal to the stem of the arm 54 is forced downwardly. When the disc 42 is deformed in this manner, the arm 54 is pivoted on the fulcrum 56 to move the movable contact 44 into upwardly spaced relation with the fixed contact 40. As a result of the cooperation of the bimetallic disc 40 with the post 46, the dimple 58, and the actuator disc 42, a slight amount of snap travel in the disc 50 is amplified over the length of the arm 54 to effect substantial separation between the contacts 44 and 40 and thereby provide positive interruption of electrical continuity between the first and second terminals 14 and 16. Slight resilient pressure between the contacts 40 and 44 when the disc 50 is in its unstressed position prevents arcing therebetween when the disc 50 passes through its "creep range" to further assure positive and accurate switching. The unique way in which the disc 42 effectively amplifies the movement of the snap travel of the disc 50 permits miniaturization of the switch 10 without sacrificing accuracy or reliablility. In addition as previously explained, since the pressure on disc 42 is provided by the edge of bimetallic disc 50, where its snap travel is the greatest, this results in further maximization of movement of contact 44 for a given size bimetallic disc. Even if fulcrum 26 were to be located approximately half way along the length of arm 54, the switch 10 would still represent a significant step forward in the art, since the configuration of actuator disc 42 is such that during deformation the stresses are not limited solely to the arm 54 but rather are distributed also around the ring 52, thereby minimizing stress concentrations in the disc 42.

Figure 6:
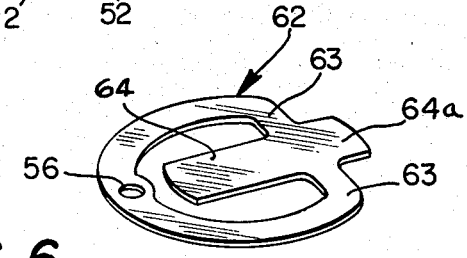
FIG. 6 is a perspective view of an alternate actuator disc.

In instances where further resilient pressure between contacts 40 and 44 is desired, an actuator disc of the type generally indicated at 62 in FIG. 6 may be substituted for the disc 42 in the switch 10. Specifically, disc 62, instead of being circular, is provided with inwardly extending portions 63 which communicate with arm 64 at a point adjacent fulcrum 26 to defined an outwardly extending tab 64*a*, whereby extending portions 63 are stressed torsionally to a greater degree than with the inwardly extending portions 65 of disc 42, thus resulting in correspondingly greater resilient pressure between contacts 40 and 44.

An alternate embodiment of the switch construction of the instant invention is generally indicated at 66 in FIG. 7 and comprises a single pole, double throw thermostatic switch which operates to alternatively effect electrical continuity between the first and second terminals 14 and 16 or between the second terminal 16 and a fourth terminal 68.

The switch 66 includes a base 70 which is made of an electrical insulating material such as a phenolic and is similar in configuration to the base 12 but includes additional bore 72 for receiving the fourth terminal 68 which is integrally formed with a second fixed contact 71 spaced above the fixed contact 40. A second movable contact 74 is carried on the upper side of the arm 54 and engages the second fixed contact 70 when the arm 54 is in its upwardly pivoted position.

The switch 66 operates in a manner similar to the switch 10. When the disc 50 is in its downwardly flexed position, it rests loosely on the post 46 and the ring 52 proximal to the stem of the arm 54 so that the movabvle contact 44 engages the fixed contact 40. However, when the disc 50 is stressed or flexed upwardly, it engages the dimple 58 causing downward pressure to be applied to the ring 52 proximal to the stem of the arm 54 whereby the disc 42 is resiliently deformed and the arm 54 is pivoted on the fulcrum 26 causing the first movable contact 44 to be moved upwardly and into spaced relation with the first contact 40, and causing the second movable contact 74 to be moved into engagement with the second fixed contact 70. This causes electrical continuity to be interrupted between the first and second terminals 14 and 16, respectively, and effected between the second and fourth terminals 16 and 68, respectively.

A third embodiment of the instant invention is illustrated in FIGS. 8 through 10 and generally indicated at 76. The switch 76 includes a base 78 but only includes the first and second external terminals 14 and 16. The switch 76 includes an actuator disc 80 having an outwardly extending ground tab 82 which is bent downwardly along the interior of the housing 22 during the assembly of the switch 76 to the configuration illustrated in FIG. 10 to provide positive electrical communication between the disc 80 and the housing 22. The switch 76 operates in a manner similar to switch 10 with movement of the disc 50 thereof being amplified through movement of the actuator disc arm 54. Since the switch 76 includes only the terminals 14 and 16 and since the disc 80 is in electrical communication with both the terminal 16 and the housing 22, the switch 76 does not require an insulator disc 48.

A further embodiment of the switch construction of the instant invention is generally indicated at 84 in FIG. 11. The switch 84 also comprises a single pole, single throw switch and includes an actuator disc 86 which is similar in construction to the disc 42, having a peripheral ring 87 which is engaged by a bimetallic disc 50 to effect movement of an actuator arm 88. The switch 84 includes a base 90 having a bore 34 and a slot 38, a fixed contact 40, and first and third terminals 14 and 18, respectively. An enlarged fulcrum 92 is integrally formed with the base 90, and an integrally molded, upwardly extending support post 94 is provided spaced from the fixed contact 40 on the opposite side thereof from the fulcrum 92 replacing the post 46 and the boss 30. A bore 96 extends downwardly through the post 94 and the base 90 having an electrically conductive tubular terminal member 98 with an outwardly flanged upper end 100 received therein to secure the disc 86 within the switch 84. A second terminal 16 is received in the member 98 and thereby electrically connected to the actuator disc 86. The actuator disc 86 is of the same general configuration as the disc 42 in the switch 10 with the exception that when the disc 86 is in its unstressed or undeformed position, the arm 88 extends downwardly from the plane of the ring 87 so that the movable contact 44 mounted thereon communicates with the fixed contact 40 despite the elevated height of the fulcrum 92. The switch 84 also includes a housing 22 having a dimple 58, whereby when the disc 50 moves to its upwardly flexed position, it simultaneously engages the post 94, the dimple 58 and the ring 87 proximal the stem of the arm 88 to deform the disc 86 and move the contact 44 into spaced relation with the contact 40.

A still further embodiment of the switch construction of the instant invention is generally indicated at 102 in FIG. 12. The switch 102 is similar to the switch 10 and includes the disc 42, but instead of the insulator disc 48, the switch 102 includes an insulator ring 104 having a central opening therein to provide clearance for movement of the arm 54. A support post 106 which is made of an electrical insulating material in contrast to the conductive post 46 secures the insulator and actuator discs 104 and 42 respectively on a base 105 in the switch 102. In this regard, the post 106 is received in an electrically conductive sleeve 108 which is disposed in the bore 36. The insulator ring 104 is disposed generally above the ring 52 and is interposed in engagement between the disc 50 and the ring 52 proximal to the stem of the arm 54. The second terminal 16 is received in the lower end of the sleeve 108 to provide electrical connection thereof to the actuator disc 42. The insulator disc 104 and the insulated support post 106 electrically insulate the terminal 16 and the actuator disc 42 from the housing 22 and the third terminal 18. In operation, the switch 102 also functions in a manner similar to the switch 10 with the bimetallic disc 50 causing deformation of the actuator disc 42 to move the movable contact 44 into spaced relation with the fixed contact 40 to interrupt continuity between the first and second terminals 14 and 16, respectively.

A still further embodiment of the switch construction of the instant invention is illustrated in FIG. 13 at 110. The switch 110 is of substantially the same configuration as switch 102, including an insulator ring 104 and a nonconductive support post 106. However, instead of the sleeve 108, the switch 110 includes an elongated sleeve 112 which extends downwardly from base 113 and is secured thereto with a concave retainer washer 114 as illustrated in FIG. 13.

It is seen therefore that the instant invention provides a novel miniature switch construction which has significant advantages over the thermostatic switch constructions of the prior art. In particular, by incorporating a lever arm which carries a movable contact, it is possible to sufficiently amplify the snap travel or flexing movement of a miniature bimetallic disc to provide accurate and reliable switching. Accordingly, since the size of the bimetallic disc is normally the main limitation in the miniaturization of bimetallic switches, the instant invention represents a significant development in the field of thermostatic switches which overcomes this constraint to provide a switch construction which is effective with bimetallic discs of reduced size.

While there is shown and described herein certain specific structure embodying this invention, it will be manifest to those skilled in the arm that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A thermostatic switch comprising a housing having a base portion, a fulcrum on said base, a resiliently deformable, electrically conductive member having an integral arm blanked therein, said member overlying said fulcrum, said arm having a first movable contact adjacent its free extremity, said fulcrum maintaining said member in generally spaced relation to said base, means securing said member to said base in such a way that the portion of said member adjacent the connected end of said arm is free to deform, a first fixed contact mounted in said housing adjacent said movable contact, said arm being movable between a first position wherein said contacts are in engagement with each other to effect electrical continuity and a second position wherein said contacts are separated to interrupt said continuity, and bimetallic means in said housing automatically actuated in response to a predetermined temperature change and cooperating with said deformable member when actuated to deform the latter at a point adjacent the connected end of said arm, thereby causing said arm to pivot on said fulcrum to either open or close said contacts.

2. In the switch construction of claim 1, said arm overlying said fulcrum at a point adjacent the connected end of said arm.

3. In the switch construction of claim 1, said electrically conductive member further characterized as an actuator disc having a substantially circular peripheral ring, said arm extending substantially radially inwardly from said ring, said means securing said member further characterized as means securing said ring to said base at a point which is adjacent the free end of said arm.

4. A thermostatic switch construction comprising:

a. a base made of an electrical insulating material;

b. fulcrum means on said base;

c. first and second external electrical terminal means on said base;

d. an electrically conductive actuator disc electrically connected to said second terminal means having a resiliently deformable body section and an actuator arm which extends integrally from said body section, said body section being secured to said base at a point which permits the portion of said body section which is adjacent the connected end of said arm to be resiliently deformed, and with said arm overlying said fulcrum means at a point intermediate the length of said arm, whereby movement of the portion of said actuator disc which is proximal to said connected end toward said base moves said actuator disc from an undeformed position to a deformed position with said arm pivoting on said fulcrum means to move the terminal portion of said arm away from said base;

e. a first movable contact on the terminal portion of said arm;

f. a first fixed contact mounted on said base electrically connected to said first terminal means and in electrical communication with said movable contact when said actuator disc is in one of its said positions and spaced therefrom when it is in the other of its said positions;

g. a bimetallic disc automatically actuated in response to a predetermined temperature; and h. means positioning said bimetallic disc in said switch so that when the interior portion thereof is flexed away from said base, the peripheral portion thereof communicates movement to said actuator disc proximal to said connected end to move said actuator disc from said undeformed to said deformed position.

5. In the switch construction of claim 4, said arm overlying said fulcrum means at a point adjacent the connected end of said arm.

6. In the switch construction of claim 4, said body section further characterized as a substantially circular ring which defines an open interior area of said actuator disc, said arm extending substantially radially inwardly from said peripheral ring into said open area.

7. In the switch construction of claim 4, said retaining means comprising:

a. a support post which extends upwardly from said base and communicates with substantially the opposite peripheral portion of said bimetallic disc as said actuator disc; and b. means positioning said actuator and bimetallic discs in general alignment and communicating with the interior portion of said bimetallic disc when it is flexed away from said base, so that the peripheral portion thereof simultaneously communicates with said post and said actuator disc portion proximal to said connected end to move said actuator disc from its undeformed to its deformed position.

8. In the switch construction of claim 7, said positioning means comprising an enclosure on said base which houses said first fixed and movable contacts, said fulcrum means, said post, said actuator disc and said bimetallic disc.

9. In the switch construction of claim 8, said enclosure further characterized as being electrically conductive, said switch construction further comprising means electrically insulating said enclosure from said first and second terminal means, and third terminal means electrically connected to said enclosure.

10. In the switch construction of claim 8, said enclosure further characterized as having an inwardly projecting abutment which is engaged by said bimetallic disc upon the flexing of the interior portion thereof away from said base to effect said communication thereof with said post and said actuator disc.

11. In the switch construction of claim 9, said enclosure further characterized as having an inwardly projecting abutment which is engaged by said bimetallic disc upon the flexing of the interior portion thereof away from said base to effect said communication with said post and said actuator disc.

12. In the switch construction of claim 8, said post comprising a metallic post which is electrically connected to said second terminal means and which extends through said actuator disc ring to effect the electrical connection of said actuator disc to said second terminal means and the securement thereof to said base.

13. In the switch construction of claim 9, said post comprising a metallic post which is electrically connected to said second terminal means and which extends through said actuator disc ring to effect the electrical connection of said actuator disc to said second terminal means and the securement thereof to said base.

14. In the switch construction of claim 11, said electrical insulating means comprising an insulator disc which is interposed between said bimetallic disc and said actuator disc, and said bimetallic disc and said post.

15. In the switch construction of claim 4, said actuator disc further characterized as having inwardly extending portions which extend from said body section into communication with said arm at a point intermediate the length of the latter to define an outwardly extending tab, said bimetallic disc communicating with said tab to move said actuator disc from its undeformed to its deformed position.

16. The switch construction of claims 4, 10 or 11, further comprising fourth external electrical terminal means on said base, a second movable contact on the opposite side of said arm from said first movable contact, and a second fixed contact mounted on said base and in electrical communication with said second movable contact when said first movable and fixed contacts are in spaced relation and spaced from said second movable contact when said first movable and fixed contacts are in electrical communication.

17. In the switch construction of claim 8, 10 or 12, said actuator disc further characterized as having a contact tab which extends outwardly from said ring and engages said enclosure to effect electrical continuity therebetween.

18. In the switch construction of claims 7 or 8, said post further characterized as comprising a support member which is integrally molded with said base and an electrically conductive tubular terminal member which is electrically connected to said second terminal means and extends through said actuator disc to effect the securement thereof to said base.

19. The switch construction of claim 7, further comprising an electrically conductive sleeve which is electrically connected to said second terminal means and extends through said actuator disc to effect the attachment thereof to said base and the electrical connection therebetween, said post further characterized as being made of an electrical insulating material and being received in said sleeve to effect the attachment thereof to said base and also further effect the attachment of said actuator disc to said base.

20. In the switch construction of claim 19, said sleeve extending through said base and extending outwardly therefrom to comprise said second terminal means, said switch construction further comprising a retainer washer retaining said sleeve in said base.

21. In the switch construction of claim 19, said sleeve extending through said base, said second terminal means being received in the end of said sleeve opposite from said post to effect electrical connection thereof to said sleeve.

* * * * *

UNITED STATES PATENT AND TRADEMARK OFFICE

CERTIFICATE OF CORRECTION

PATENT NO. : 4,367,452

DATED : January 4, 1983

INVENTOR(S) : CARLSON, Richard H.

It is certified that error appears in the above-identified patent and that said Letters Patent is hereby corrected as shown below:

Column 8, line 52, before "means" insert --retaining--.

Signed and Sealed this

*Fifteenth* Day of *May 1984*

[SEAL]

*Attest:*

GERALD J. MOSSINGHOFF

*Attesting Officer*

*Commissioner of Patents and Trademarks*